US005130684A

United States Patent [19]

Scott et al.

[11] Patent Number: 5,130,684

[45] Date of Patent: Jul. 14, 1992

[54] CIRCUIT BREAKER WITH SELF-ALIGNING THERMAL TRIP

[75] Inventors: Gary W. Scott, Mt. Vernon; Christopher K. Goble, Marion; David Pearson, Cedar Rapids, all of Iowa

[73] Assignee: Square D Company, Palatine, Ill.

[21] Appl. No.: 499,915

[22] Filed: Mar. 27, 1990

[51] Int. Cl.[5] ..... H01H 75/12; H01H 71/16

[52] U.S. Cl. ..... 335/43; 337/70

[58] Field of Search ..... 337/70, 71, 72, 73, 337/74, 75, 76, 62, 66; 335/43, 45, 39, 40, 41, 42, 35

[56] References Cited

U.S. PATENT DOCUMENTS

| | | | |
|---|---|---|---|
| 2,824,931 | 2/1958 | Ingwersen . | |
| 3,182,152 | 5/1965 | Jenner . | |
| 3,210,501 | 10/1965 | Clarke . | |
| 3,319,031 | 5/1967 | Butler et al. . | |
| 3,629,762 | 12/1971 | Walling | 337/62 |
| 3,771,087 | 11/1973 | Riendeau | 337/112 |
| 3,868,614 | 2/1975 | Riendeau | 337/66 |
| 4,110,719 | 8/1978 | Kirkup | 337/46 |
| 4,325,041 | 4/1982 | Murai | 335/35 |
| 4,513,268 | 4/1985 | Seymour et al. | 335/35 |
| 4,514,709 | 4/1985 | Nakano et al. | 335/201 |
| 4,516,098 | 5/1985 | Krasser et al. | 335/35 |
| 4,559,510 | 12/1985 | Franz . | |
| 4,616,200 | 10/1986 | Fixemer et al. | 335/35 |
| 4,672,351 | 6/1987 | Cheng | 337/123 |

*Primary Examiner*—Harold Broome

*Attorney, Agent, or Firm*—Jose W. Jimenez; Robert J. Crawford

[57] ABSTRACT

A bimetallic thermal release element (34) for use in a thermally actuated tripping mechanism, and in particular used in electrical circuit breakers (10) wherein the load current is passed through the bimetallic element has a self-aligning floating latch member (141) configured to engage the release member and to disengage therefrom when the bimetallic element bows a sufficient amount at a given temperature or current. The bimetallic element is preferably an elongated member supported at its ends (128, 130) by side members (28, 42). An increased sensitivity is imparted to the bimetallic element by mounting the side members for rotation to accommodate the bowing.

20 Claims, 4 Drawing Sheets

CIRCUIT BREAKER WITH SELF-ALIGNING THERMAL TRIP

TECHNICAL FIELD

The technical field of the invention is the electrical circuit breaker art.

BACKGROUND OF THE INVENTION

In the electric circuit breaker art where a bimetallic element is used to flex or bow a given degree in response to passage of electrical current therethrough, a latch of one form or another is provided having a latch member engaging the bimetallic element over a given range of temperatures, and hence currents. Terminal bowing or flexing of the bimetallic element causes disengagement of the latch member to trip the breaker. The bimetallic element or the latch member must be movable with the contacts, the other contact remaining stationary during the contact-breaking process. It is desirable that the tripping temperature or tripping current be established within a fairly close tolerance, therefore a setscrew mechanism is frequently utilized to adjust the position of the latch with respect to the bimetallic element in the unbowed condition, so as to variably adjust the tripping temperature or current. Elimination of such setscrew mechanisms has been a design objective in the electrical circuit breaker art.

SUMMARY OF THE INVENTION

According to a feature of the invention, a thermal tripping unit, applicable in particular to circuit breakers, is provided with a bimetallic thermal sensing element through which load current is passed. In the preferred form of the invention a bimetal assembly is provided having the bimetallic element configured as an elongated strap rigidly affixed to conducting electrical side-members having their axes parallel, the side members being mounted for axial movement to carry electrical contacts mounted at side member ends into and out of engagement with stationary contacts adapted for connection to the line and load. The bimetal assembly is spring-urged in a contact-breaking direction, and is restrained by a rotatable elongated latch member having a major face generally confronting one face of the bimetallic element, and away from which the bimetallic element bows upon heating. A central portion of the latch member is configured for engagement with a central engaging portion of the bimetallic element. Ends of the latch member are provided with forwardly facing projections or support portions disposed to arrestingly contact the bimetallic element to place the major confronting face of the latch member at a distance from the central engaging region of the bimetallic element, thus establishing the degree of engagement of the latching portion with the bimetallic element. The engaging portion of the latch member engages the bimetallic element by entering a slot passing therethrough. The latch member is mounted for movement towards the bimetallic element, and is biased into engagement by spring biasing means.

As the bimetallic element bows under heating, the constant engagement of the latching portions of the latch member is maintained with the end regions of the bimetallic element (or alternatively by engagement with the side members) so that the amount of bowing of the bimetallic element in the region between the latch member support portions governs the temperature of withdrawal of the latch portion from the bimetallic element and, thus, the tripping temperature or current. The use of set screws to adjust the initial spacing between latch member and bimetallic element is thus eliminated.

The simply supported beam of the present invention helps to eliminate the pigtail connector between the bimetal and one of the contacts and improves calibration repeatability of the circuit breaker. The cantilever bimetal has about four (4) times the deflection but about one-fourth the force of a simply supported beam bimetal of the present invention. The advantage is that two supports fix the bimetal position much more precisely than a short braze weld to one fixed end on a cantilever.

Other features and advantages of the invention will become apparent upon making reference to the specification to follow, the drawings and the claims.

DETAILED DESCRIPTION OF THE PREFERRED EMBODIMENTS

Figure 2:
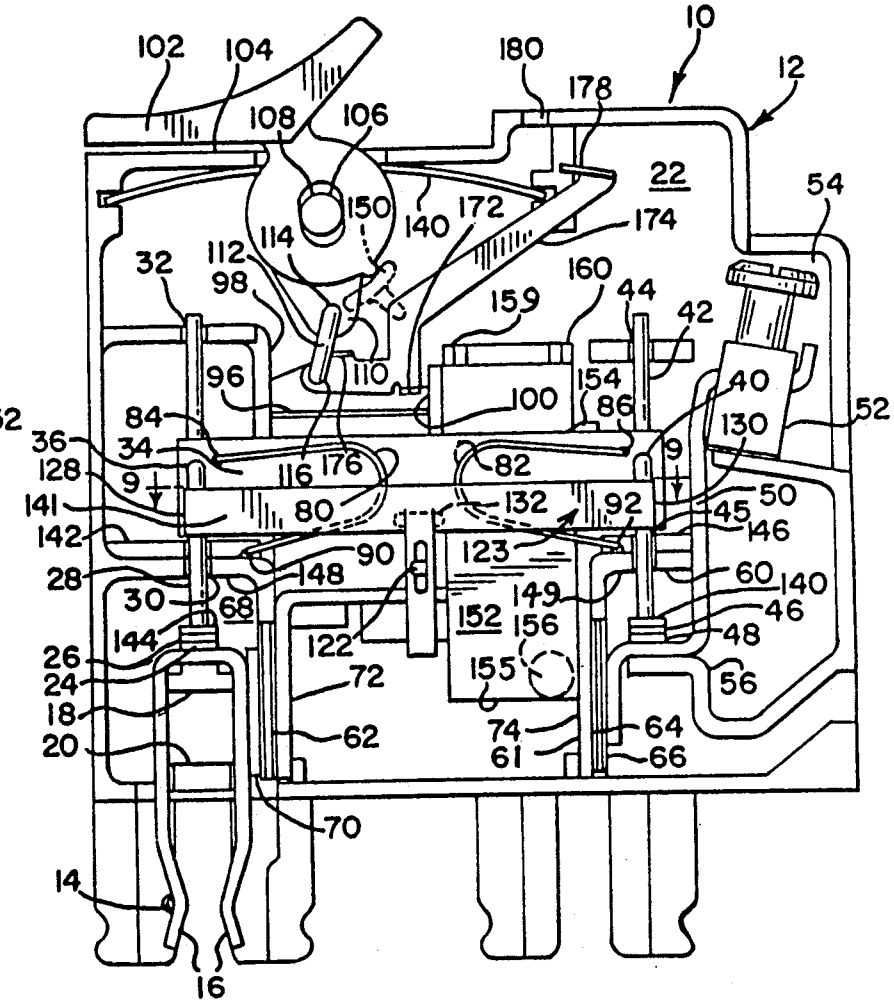
FIG. 2 is a view similar to FIG. 1, having portions thereof removed for clarity.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiment illustrated.

Figure 1:
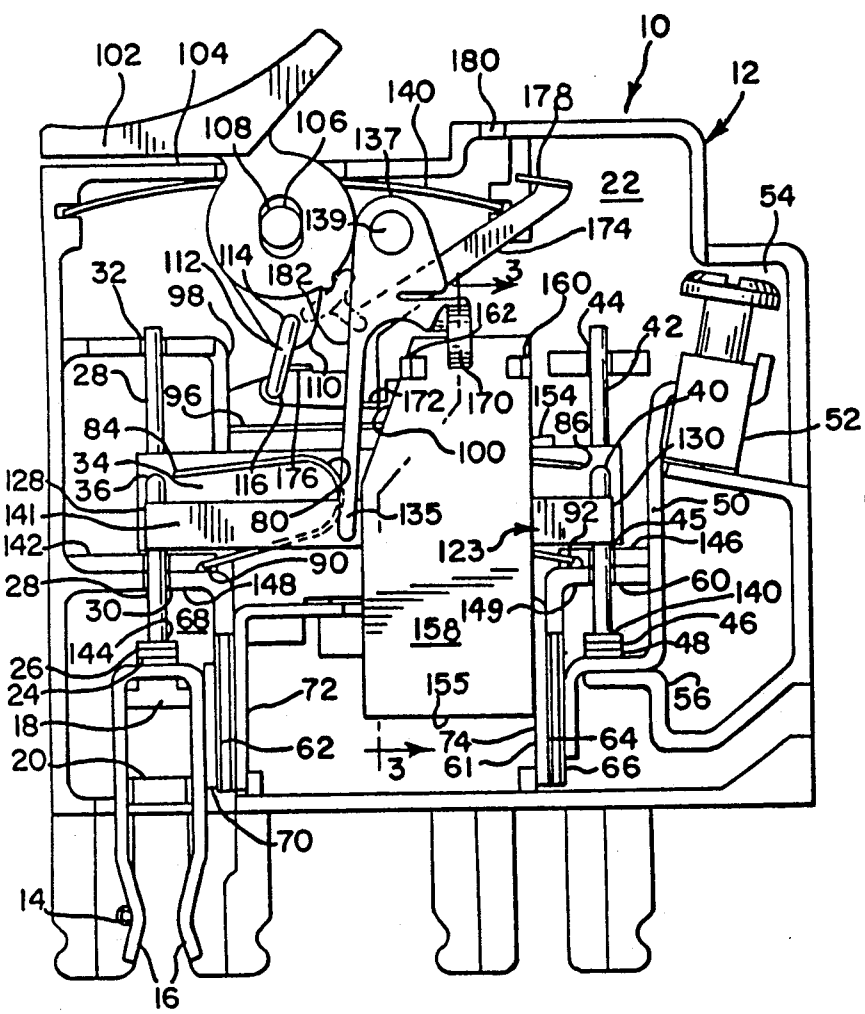
FIG. 1 is a partially cutaway view of a circuit breaker with the contacts in the closed (ON) position.

Referring now to the figures, and in particular to FIGS. 1 and 2, these figures show the principal elements of a breaker 10 mounted in a rear housing half 12. The breaker 10 is preferably fabricated as a two-piece housing having a front housing half (not shown), both housing halves being configured to be interfitting where necessary to provide cooperating guiding and supporting structures for the various elements of the breaker 10.

The breaker 10 of the present invention is shown with the contacts in the closed (ON) position. Considering first the electrical current flow system, a line terminal 14 having outwardly extending jaws 16 is captively secured to the housing 12 by posts 18, 20 integrally formed and extending forward from the rear housing wall 22. A tungsten contact 24 is affixed to the inner end of the line terminal 14. A similar contact 26 is affixed to the lower end of a cylindrical carrier rod (side member) 28 mounted for sliding movement through cylindrical first housing passages 30, 32.

A bimetal shorting bar 34 is mechanically and electrically secured to the carrier rod 28 by a deformation 36 formed from a rod protrusion passed through an aperture (not shown) in the end of the shorting bar, and afterwards deformed to make a mechanical and electrical contact therebetween. The opposite end of the shorting bar 34 is similarly mounted by a deformation to a similar carrier rod (side member) 42 slidably mounted in second housing passages 44, 45. The lower end of the rod 42 is similarly provided with a tungsten contact 46. Final electrical connection is made through a tungsten contact 48 mounted on a generally strap-shaped load terminal 50 having a lug 52 at the upper end thereof and accessible through a housing passage 54. The load terminal 50 is held in place by conforming wall portions 56, 60.

Protection against contact arcing caused by inductive surges on break is provided by a generally U-shaped arc shunt 61. Gaps 62, 64 are provided in the housing portions 66, 68 confronting and retaining outer legs 72, 74 of the arc shunt 61. An arc plate 70 is provided in contact with the right-hand jaw 16 of the line terminal 14, so that a high voltage arc will be struck between the arc plate 70 and the arc shunt leg 72. A similar arc will be struck between the lower end 64 of the load terminal 50 and the right-hand leg 74 of the arc shunt 61.

Considering next the mechanical aspects of the breaker 10, with the breaker in the ON position as shown, an upward force is exerted on the bimetal shorting bar 34 by a pair of springs 80, 82 (see FIG. 2), each spring being captively secured at one end to the shorting bar 34 by passage through apertures 84, 86 and are compressingly secured at their other ends to the housing shoulders 90, 92. Upward movement of the shorting bar 34 induced by the force of the springs 80, 82 to break the electrical connection between the contacts 24, 26 and 46, 48 is restrained by a latching mechanism which will be discussed next.

Referring now also to FIGS. 2, 3, 8 and 11, a sliding carrier 96 is mounted for vertical reciprocating movement along parallel ways 98, 100 (see FIG. 2) forwardly extending from the rear housing wall 22. A rocker-type handle 102 extending outward of top wall 104 of the housing 12 is pivotally rotatable about a pivot post 106, the handle 102 having an oval hole 108 configured for loose engagement with the pivot post 106. A handle extension 110 projects towards the carrier 96, and is coupled thereto by a U-shaped link 112 at upper and lower pivot points 114, 116. Rotation of the handle 102 will thus cause a reciprocating up and down motion of sliding carrier 96. The sliding carrier 96 is releasably attached to the bimetal shorting bar 34, as will be discussed.

Referring in particular to FIGS. 3, 5, 7, 8, 9 and 11, an upstanding extension 120 is provided at the lower right-hand corner of the sliding carrier 96, the extension 120 terminating in a relatively narrow extension head 122. A generally T-shaped insulating latch member 123 (see also FIG. 8) having a slot 124 passing through a downwardly extending nose piece of portion 126 thereof is press fitted over the extension head 122 to be captively rotatably secured thereto. Outer ends 128, 130 of the latch member 123 extend over and are supported by engagement of support portions 129, 131 (see also FIG. 9) with the carrier rods 28, 42, and the deformed portions 36, 40 (see FIG. 1).

The bimetal shorting bar 34 is provided with a rectangular central slot 132 therein (see also FIG. 4), and the latch member 123 is provided with a rectangular inwardly facing short projection 134 having a latch face 136 thereon configured to engage the lower edge of the slot 132. A biasing force for urging the latch projection 134 into the slot 132 is provided by a downwardly extending extension 135 of a spring 137 (FIG. 1) attached to a post 139 extending forward from the rear housing wall 12, this extension being in contact at all times with a generally planar major outer surface 141 of the latch member 123. The post 139 and spring 137 are deleted from all views except FIG. 1 for clarity.

The bimetal shorting bar 34 is thus held captively secured against the upward urging of the springs 80, 82. This arises from the fact that the upper pivot point 114 of the link 112 (see FIG. 2) is to the right of the line of centers of the pivot post 106 and the lower link pivot point 116. A downward force is applied to the handle 102 by a biasing spring 140 engaging a camming upper rear surface (not shown) of the handle 102, biasing the handle 102 generally downward. The bimetal shorting bar 34 accordingly is forced by the aforementioned engagement with the latching member 123 into arresting engagement with forwardly extending arresting shoulders 142, 146 integral with housing 12. The above-mentioned camming surface of the handle 102 provides a stable breaker-on position shown in FIG. 1, a stable breaker-off position shown in FIG. 6, and a meta-stable center position illustrated in FIG. 4 indicating a tripped breaker.

Figures 3, 4, 5:
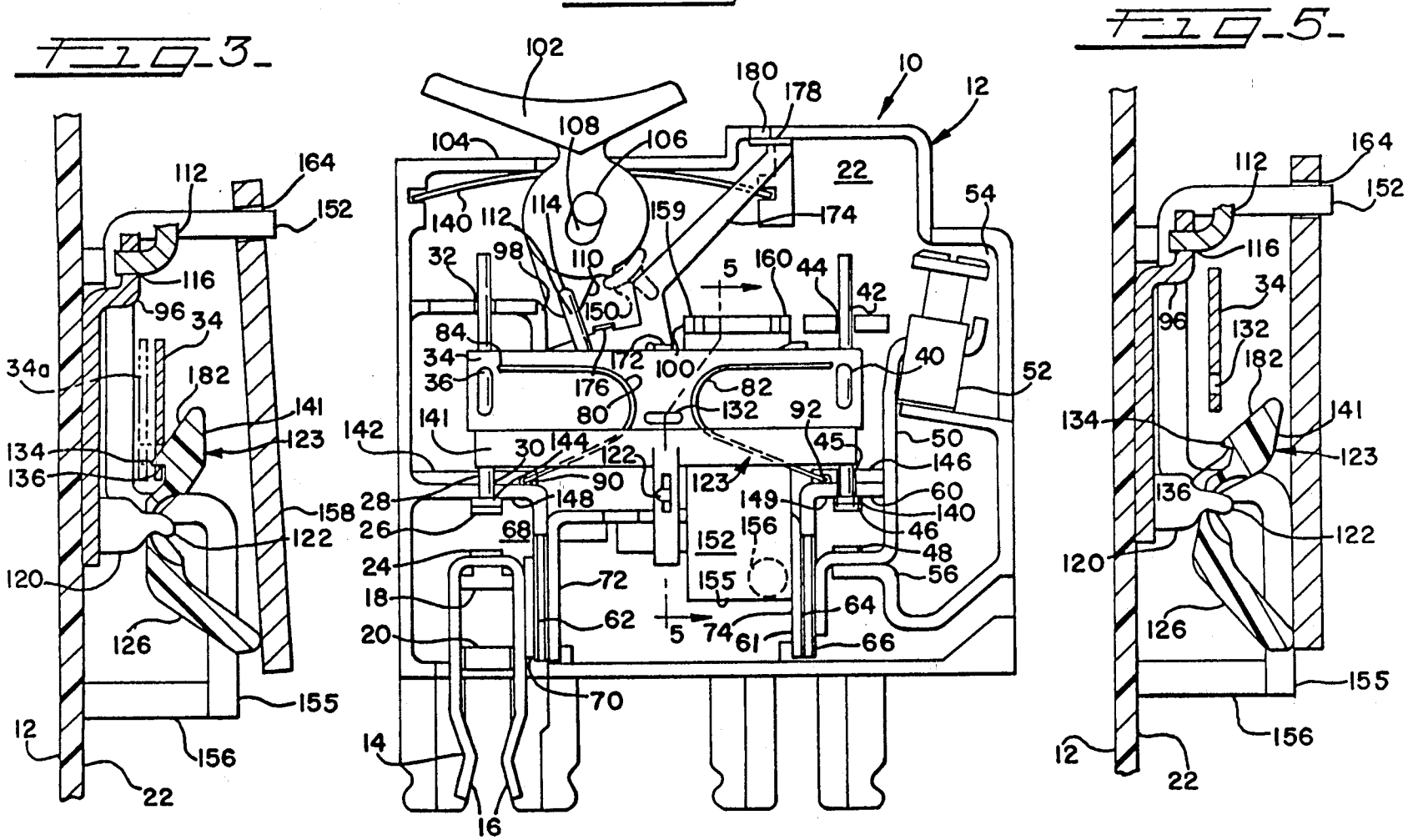
FIG. 3 is a cutaway side view of the principal elements of the central portion of the circuit breaker on cut lines 3—3 in FIG. 1, remote elements have been removed for purposes of clarity.
FIG. 4 is a view similar to FIG. 2 showing the breaker in the tripped condition.
FIG. 5 is a view similar to FIG. 3 showing the elements therein in the magnetically tripped condition, the view being taken along cut lines 5—5 show in FIG. 4.
Figure 7:
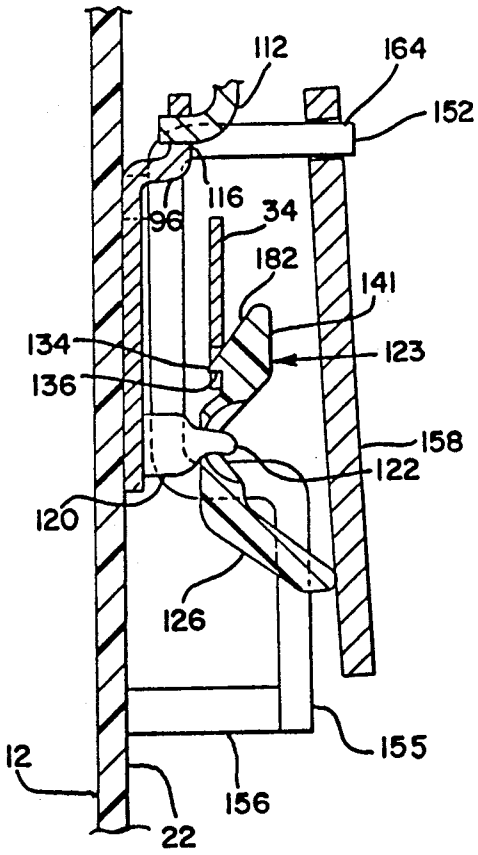
FIG. 7 is similar to the view shown in FIG. 3, the view being taken along the cut lines 7—7 shown in FIG. 6.
Figure 6:
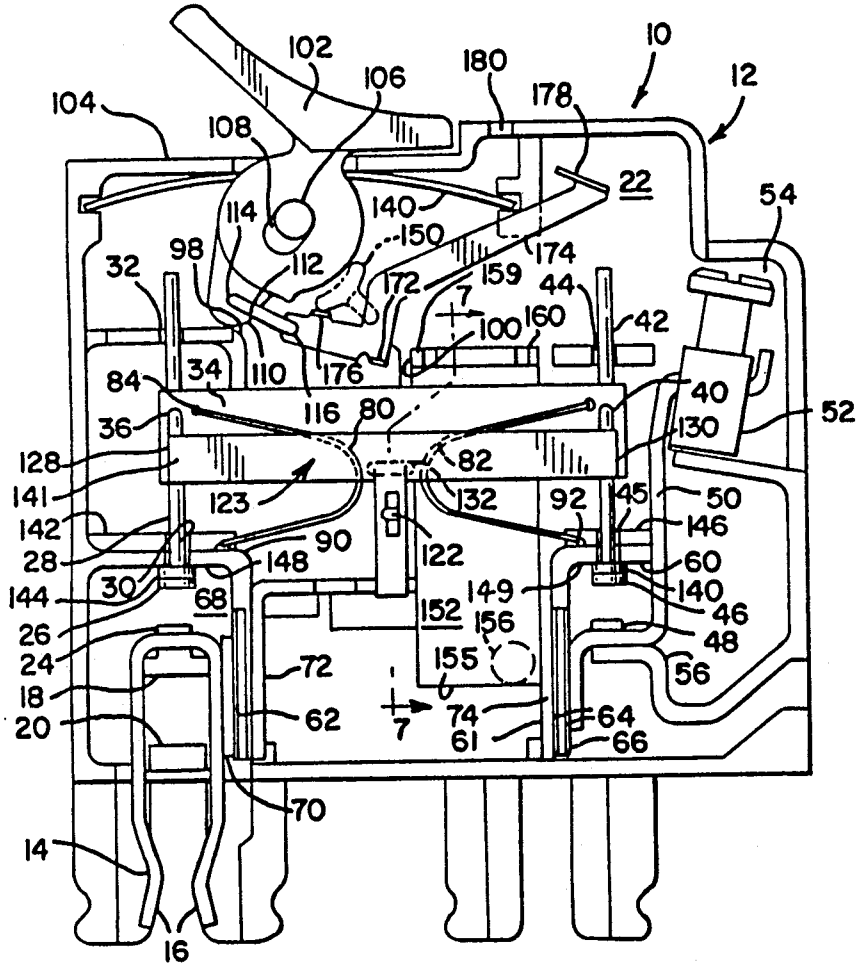
FIG. 6 is a view similar to FIG. 2 showing the breaker with the contacts in the open (OFF) position.
Figure 8:
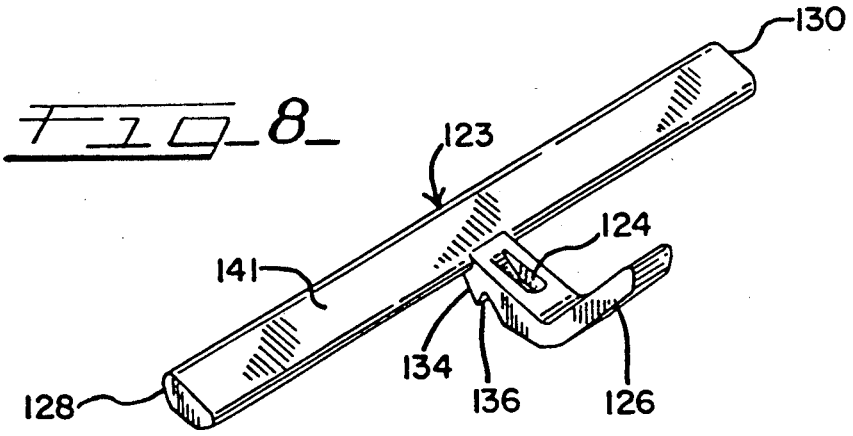
FIG. 8 is an enlarged view of a latch member employed in the breaker.

The breaker 10 is tripped by one of two mechanisms. Currents moderately above the tripping current of the breaker will cause the bimetal shorting bar to heat over time, resulting in a progressive bowing of the central portion thereof away from the latch projection 134 to disengage therefrom as shown schematically by the dotted outline **34*a* in FIG. 3, releasing the engagement between the latch member 123 and the shorting bar 34. This bowing is facilitated by rotation of the cylinder side member carrier rod 28, 36, 40 in their mounting passages 30, 32 and 44, 45. Upon such disengagement, the springs 80, 82 propel the shorting bar upwards as shown in FIG. 4, the upward travel being terminated by engagement of enlarged lower end portions 140, 144 of the carrier rods 28, 42 with interior walls 148, 149 through which passages 30, 45 extend. FIGS. 5 and 6** show the breaker and elements thereof in the tripped condition.

Figure 9:
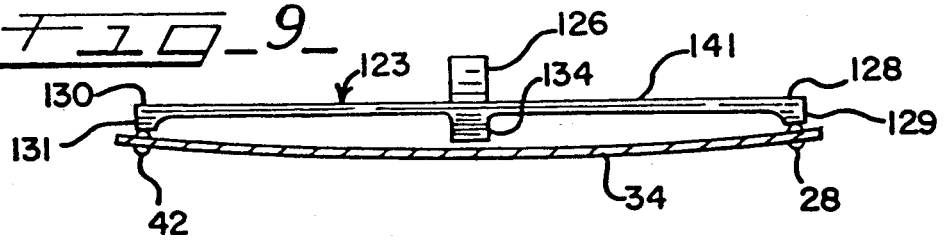
FIG. 9 is an enlarged cross-section view of the latch member of FIG. 8 in contact with a bimetallic element.

FIG. 9 is a cross-section view showing the bowing disengagement of the latch member projection 134 from the bimetallic shorting bar 34. The amount of disengagement is exaggerated for clarity. In particular, it will be noted that by supporting the latch member 123 directly against the support rods 28, 42, the amount of bowing of the bimetal shorting bar 34 necessary to cause disengagement is automatically established without the necessity for customary setscrew mechanisms used to adjust the initial relative positions of such elements.

Figure 10:
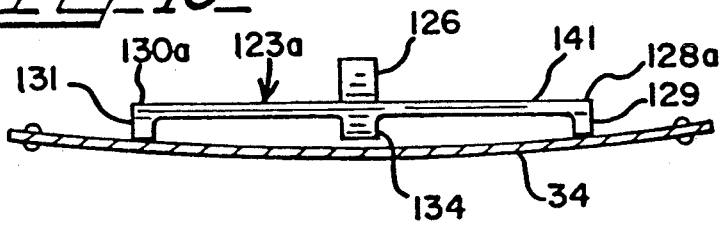
FIG. 10 shows an alternative embodiment of the latch member shown in FIG. 9.
Figure 11:
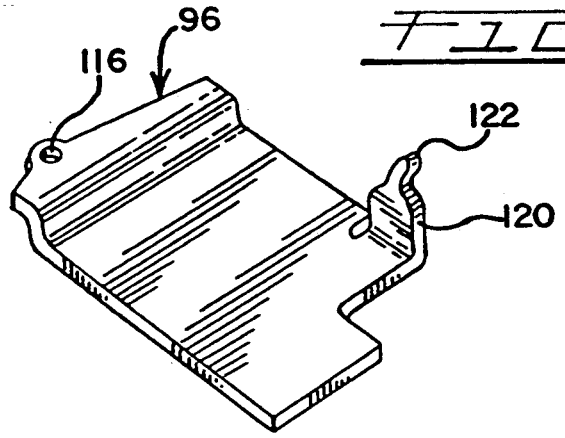
FIG. 11 is an enlarged view of a sliding carrier used in the breaker.

FIG. 10 shows an alternative embodiment of the invention. Elements having identical function in FIGS. 9, 10 are given identical part numbers. A modified latch member 123a is configured shorter, so that its engaging portions 129, 131 at ends 128a and 130a engage the shorting bar 34 directly at points intermediate the rods 28, 42. As before, the amount of bowing necessary to cause disengagement is established by the amount of bowing which occurs in the region between the support portions 129 131.

Referring to FIGS. 1 and 2, high speed tripping under conditions of sudden extremely high currents is achieved by means of a magnetic structure comprising a fixed generally U-shaped ferromagnetic yoke 152 affixed to the rear housing wall 22 between the right-hand way 100 and a post 154. In FIG. 2, the yoke 152 is provided with a downwardly extending end 155, this lower end being supported by a support post 156 extending forward from the rear housing wall 22. In FIG. 3, a movable armature plate 158 is loosely affixed to the yoke by means of armature retaining posts 159, 160 extending forwardly and passing through side slots 162, 164 passing through the upper end of the armature 158. It will be noted from FIGS. 1, 2 and 3 that the armature 158 is configured to extend over the lower end of the nose piece 126 of the latch member 123. The armature 158 is removed in FIGS. 2, 4 and 6 for purposes of clarity.

The spring 137 (FIG. 1) has a relatively short portion 170 disposed to engage the upper end of the armature 158 above the retaining posts 159, 160, so as to bias the lower end of the armature away from the nose piece 126 of the latch member 123. It will be noted in FIG. 3 that the nose piece 126 is configured to extend forward and outward away from the rear housing wall 22. A sudden surge of current well in excess of the rated current of the breaker will thus cause magnetization of the ferromagnetic yoke 152 and the armature 158, as a result of which the lower end of the armature will be urged towards the rear housing wall 22, pivoting the latch member 123 about the extension head 122 to cause disengagement of the latching face 136 from the slot 132, resulting in a tripped condition. FIG. 5 shows this tripped condition immediately after high current trip and before the spring extension 172 has had time to redeploy the armature 158 to the configuration shown in FIG. 3.

As the bimetal shorting bar 34 is propelled upward from the ON condition shown in FIG. 2 to the tripped condition shown in FIG. 4, the upper edge thereof strikes an outwardly facing extension 172 of a trip flag arm 174 pivotally mounted about the link 112 at pivot point 116. The arm 174 is thus rotated counterclockwise, and a second forwardly facing extension 176 thereof engages the link 112 to rotate the handle 102 clockwise to a generally centered position by the time the upward travel of the shorting bar 34 has been terminated. Similarly, the outer end 178 of the arm 174 is moved to a position immediately opposite a window 180 in the top wall edge 104. Suitable indicia or a suitable color is provided on this outer end 178 to serve as a trip warning.

The breaker is reset by first rotating the handle 102 clockwise to the OFF position as shown in FIG. 6. This serves to draw the sliding carrier 96 (see FIGS. 2 and 7) and the attached latch member 123 upwards, the latch member being provided with a slanting camming surface 182 enabling the extension 134 to slide up over the lower edge of the bimetal shorting bar 34, full rotation of the handle 101 to the OFF position causing the latch face 136 of the extension 134 to be disposed slightly above and beyond the slot 132. It will be appreciated that the breaker may be moved directly from the tripped to the OFF condition by a similar rotation of the handle 102, resulting in the same upward movement of the sliding carrier 96; however, in this case the bimetal shorting bar 34 will remain latched to the latch member 123 during the upward motion of the latch member.

Projecting to the rear and integral with the front housing shell (not shown in the drawings) is an extension having its boundaries indicated by dotted line 150. With particular reference to FIG. 6, with the breaker handle 102 rotated fully clockwise to the OFF position shown in FIG. 6, it will be noted that projection 176 of arm 174 is drawn into contact with the housing projection 150, causing the arm end 178 to move away from the window 180.

To complete the reset operations of the breaker, the handle 102 is next rotated counterclockwise on the condition shown in FIG. 6, forcing the sliding carrier 96 downward, and during the initial phases of this element the latch face 136 of the latch member 123 engages the lower edge of the slot 132 to capture the sliding carrier 96, the terminal phase of the downward movement of the now coupled bimetal shorting bar 34 and latch member 123 resulting in the reset or ON condition shown in FIGS. 1 and 2. It will further be noted that the arm 174 is deployed to place the flag end 178 out of alignment with the window 180 because of the engagement of extension 176 with the link 116, preventing further counter-clockwise movement until the breaker is once again tripped.

Thus, a double break circuit breaker has been described which provides for both thermal and high-current magnetic tripping, and which further provides automatic alignment of the thermal latching system and provides increased sensitivity.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details. Furthermore, while, generally, specific claimed details of the invention constitute important specific aspects of the invention in appropriate instances, even the specific claims involved should be construed in light of the doctrine of equivalents.

We claim:

1. A thermally controlled movable mechanism operable between first and second positions comprising:

mechanism biasing means for biasing said mechanism toward said first position;

a bimetallic member having a selected portion for engagement;

latching means for releasably holding said mechanism in said second position by engaging said selected portion of the bimetal member and including means for releasing said mechanism at a given temperature, said latching means including a rigid latching member having a latching portion configured for arresting engagement with said selected portion of said bimetal member;

support portions on said latching member disposed on opposite sides of said latching portion;

aligning means affixed to opposite sides of said selected portion of said bimetallic member and disposed for contacting engagement with said support portions; and latching member biasing means for biasing said support portions into contact with said aligning means and said latching portion into engagement with said selected portion of said bimetallic member.

2. The thermally controlled movable mechanism according to claim 1 wherein said bimetallic member has a generally central engaging portion and edge portions on either side of said engaging portion; and mounting means connected to said edge portions for supporting said bimetallic member wherein said mounting means is configured as a pair of side members each rigidly affixed to a different one of said bimetallic member edge portions and including means for permitting independent rotation of each of said side members.

3. A circuit breaker comprising;

a housing;

a pair of stationary contacts disposed within said housing;

a thermally controlled movable mechanism operable between first and second positions and having mechanism biasing means for biasing said mechanism toward said first position;

a bimetallic member disposed within said housing and having a selected portion of engagement;

latching means for releasably holding said mechanism in said second position at said selected portion of the bimetallic member and including means for releasing said mechanism at a given temperature;

said latching means including a rigid latching member having a latching portion configured for arresting engagement with said selected portion of said bimetallic member;

support portions on said latching member disposed on opposite sides of said latching portion;

aligning means affixed to opposite sides of said selected portion of said bimetallic member and disposed for contacting engagement with said support portions; and latching member bias means for biasing said support portions into contact with said aligning means and said latching portion into engagement with said selected portion of said bimetallic member.

4. The circuit breaker according to claim 3 wherein said mechanism includes movable contact means for making electrical contact with said stationary contacts when said mechanism is in said second position; and means for passing at least a portion of a current through said bimetallic member when said contact means are in said second position such that heating of said bimetallic member releases said contact means to said first position, said mechanism biasing means including means for urging said movable contact means to said first position.

5. The circuit breaker according to claim 4 further including reset means, operable between first and second reset means positions, for returning said contact means from said first position to said second position and said latching means to said latching position responsively to movement of said reset means from said first reset means position, to said second reset means position; said bimetallic member being affixed to said contact means to allow movement therewith.

6. The circuit breaker according to claim 5 wherein said latching member is mounted for movement to first and second latching member positions respectively, and is coupled to said reset means so that said latching member is moved to said first position responsively to movement of said reset means from said second to said first reset means positions to permit said contact biasing means to operate said contact means to said first position; and means for re-engaging said latching member to said contact means responsively to movement of said latching member from said first member position to said second member position when said contact means is in said first position.

7. The circuit breaker according to claim 3 wherein said contact means includes first and second electrically conducting side members conductingly rigidly coupled to said bimetallic member on opposite sides of said selected portion thereof, side member mounting means for mounting said side members for movement to said second position and first position, said first side member having a contact at one end disposed to make an electrical contact to the load terminal of said breaker when said contact means is in said second position, such that current passing between the load and line terminals with said contact means in said second position passes through said side members and said bimetallic member.

8. The circuit breaker of claim 7 wherein said side members are configured as elongated rod-shaped members having parallel axes, and said side member mounting means include means for permitting rotation of said side members about their respective axes.

9. The circuit breaker of claim 6 wherein said latching member is provided with camming means for allowing said latching portion to move past said selected portion of said bimetallic member against the force of said latching member biasing means when said bimetallic member is moved into said first position direction with said contact means in said first position.

10. The circuit breaker of claim 9 wherein said camming means includes a camming surface provided on said latching portion, said latching portion being provided with a shoulder-forming surface configured to captively engage said selected portion of said bimetallic member when said latching member is moved from said first member position to said second member position to said second member position to return said contact means to said second position.

11. The circuit breaker of claim 10 wherein said selected portion of said bimetallic member comprises one edge of a lengthwise slot extending through said bimetallic member, said slot being configured to accept insertion of said latching portion of said latching member.

12. The circuit breaker of claim 9 wherein said bimetallic member is substantially planar and said latching member is configured as an elongated bar disposed about said bimetallic member.

13. The circuit breaker of claim 7 including a magnetic release having a movably mounted ferromagnetic armature proximate to said bimetallic member and movably responsive to currents passing therethrough, said armature being disposed to engagingly urge said latching member to release said engagement responsively to currents above a chosen value.

14. The circuit breaker of claim 13 including means for permitting rotation of said latching member from an unrotated position placing said latching member portion in position for latching engagement with said selected portion of said bimetallic member to a rotated position withdrawing said latching member portion from said engagement, said latching member biasing means including means for urging said latching member to said unrotated position, and said armature is disposed to engagingly rotate said latching member against the force of said latching member biasing means to release said engagement responsively to currents above said chosen value.

15. The circuit breaker of claim 14 wherein said bimetallic member is configured as an elongated strap-shaped member rigidly coupled at the ends thereof to said side members to be carried therebetween and having a slot therein configured for engagement with said latching portion of said latching member, said contact biasing means includes one or more springs disposed to urge said bimetallic member in a said first position direction, said reset means includes an externally accessible handle mounted for reciprocating rotational movement between said first and second reset positions and a carrier mounted for movement into said second position and first position directions and coupled to said handle to be reciprocatingly driven by the reciprocating rotation thereof, said carrier being permanently coupled to said latching member to move said latching member in said second position and first position directions.

16. The circuit breaker of claim 15, wherein said latching member is a substantially T-shaped member having outer ends disposed to be slidably supported on said side members and a central stem portion, said carrier including latching member mounting means for mounting said latching member for rotational movement of said latching portion away from said bimetallic member when engaged therewith, said armature means disposed to engagingly urge said stem portion to rotate said latching portion out of engagement with said bimetallic member responsively to currents above said chosen value, said latching portion being configured as a ramp to permit non-engaging passage of said latching portion across said slot in said bimetallic member attendant to movement of said latching member into said first position direction with said contact means in said first position and to re-engage said slot responsively to subsequent movement of said latching member into said second position direction to reset said breaker.

17. The circuit breaker of claim 16 including resilient armature biasing means for urging said armature out of engagement with said latching member.

18. A circuit breaker comprising:

a housing;

a pair of stationary contacts disposed within said housing;

a pair of conducting cylindrical rods each having an electrical rod contact on one rod end;

mounting means within said housing for mounting said rods for parallel movement carrying their associated rod contacts into and out of contacting engagement with said stationary contacts and for rotation about their individual rod axes;

a bimetallic strap having a pair of outer strap ends, each of said strap ends being rigidly affixed to a different one of said rods, said strap having a slot in a central portion thereof oriented lengthwise along said strap;

first spring biasing means for biasing said bimetallic strap to carry said rod contacts away from contacting engagement with said stationary contacts;

a rigid elongated latching member having a centrally disposed latching projection configured for arresting engagement with said slot and support portions disposed on opposite sides of said latching projection;

aligning means affixed to said opposite sides of said central portion of said bimetallic strap;

second spring biasing means for biasing said support portions into contact with said aligning means and said latching projection into engagement with said slot; and restraining means coupled to said latching member for holding said latching member stationary with respect to said stationary contacts against the force of said first spring biasing means with said latching projection engaged with said slot and said rod contacts in contact with said stationary contacts.

19. The circuit breaker of claim 18 wherein said support portions are disposed to contactingly engage said rods so that said rods serve as said aligning means.

20. The circuit breaker of claim 18 wherein said support portions are disposed to engage side portions of said bimetallic strap on opposite sides of said central portion so that said side portions serve as said aligning means.

* * * * *